US010217622B2

(12) United States Patent
Bajic

(10) Patent No.: US 10,217,622 B2
(45) Date of Patent: Feb. 26, 2019

(54) AMBIENT IONISATION WITH AN IMPACTOR SPRAY SOURCE

(71) Applicant: MICROMASS UK LIMITED, Wilmslow (GB)

(72) Inventor: Stevan Bajic, Sale (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/855,651

(22) Filed: Dec. 27, 2017

(65) Prior Publication Data

US 2018/0197728 A1 Jul. 12, 2018

Related U.S. Application Data

(63) Continuation of application No. 15/121,916, filed as application No. PCT/GB2015/050566 on Feb. 26, 2015, now Pat. No. 9,870,908.

(30) Foreign Application Priority Data

Feb. 26, 2014 (EP) ..... 14156748
Feb. 26, 2014 (GB) ..... 1403335.1

(51) Int. Cl.
*H01J 49/16* (2006.01)
*H01J 49/10* (2006.01)
*H01J 49/14* (2006.01)

(52) U.S. Cl.
CPC ..... *H01J 49/142* (2013.01); *H01J 49/16* (2013.01)

(58) Field of Classification Search
CPC .... H01J 49/16; H01J 49/0445; H01J 49/0468; H01J 49/061; H01J 49/10; H01J 49/14;
(Continued)

(56) References Cited

U.S. PATENT DOCUMENTS 6,294,779 B1 * 9/2001 Apffel ..... G01N 30/7253 250/288
6,410,915 B1 * 6/2002 Bateman ..... H01J 49/0431 250/281
(Continued)

FOREIGN PATENT DOCUMENTS

DE 102013009177 A1 1/2014
JP 2007165116 A 6/2007
(Continued)

OTHER PUBLICATIONS

Zoltan Takats et al., "Ambient mass spectrometry using desorption electrospray ionization (DESI): instrumentation, mechanisms and application in forensics, chemistry, and biology", Journal of Mass Spectrometry, vol. 40, No. 10, pp. 1261-1275, Oct. 2005.
(Continued)

*Primary Examiner* — David A Vanore
(74) *Attorney, Agent, or Firm* — Womble Bond Dickinson (US) LLP; Deborah M. Vernon; Heath T. Misley

(57) ABSTRACT

An ion source is disclosed comprising a nebulizer 1 arranged and adapted to emit a liquid spray, a first target 5 arranged downstream of the nebulizer 1, wherein the liquid spray is arranged to impact upon the first target 5, and a sample target 10 arranged downstream of the first target 5, wherein a sample to be analyzed is provided at the sample target 10.

20 Claims, 4 Drawing Sheets

(58) Field of Classification Search
CPC .. H01J 49/24; H01J 49/26; H01J 49/04; H01J 49/0404; H01J 49/145; H01J 49/168; H01J 49/0004; H01J 49/0409; H01J 49/0431; H01J 49/045; H01J 49/0459; H01J 49/062; H01J 49/067; H01J 49/107; H01J 49/142; H01J 49/165; G01N 27/624; G01N 30/724; G01N 30/7253
USPC ..... 250/288, 282, 281, 423 R, 396 R, 424, 250/425, 283, 286, 287, 292, 294, 295, 250/397, 423 F, 423 P, 426, 427
See application file for complete search history.

(56) References Cited

U.S. PATENT DOCUMENTS 6,462,336 B1 * 10/2002 Bajic ..... H01J 49/04 250/281
7,140,231 B2 11/2006 Arii
7,193,223 B2 3/2007 Franzen
7,335,897 B2 * 2/2008 Takats ..... H01J 49/0404 250/282
7,982,185 B2 * 7/2011 Whitehouse ..... H01J 49/045 250/282
8,232,520 B2 * 7/2012 Cristoni ..... H01J 49/04 250/281
8,481,922 B2 * 7/2013 Musselman ..... H01J 49/0404 250/281
8,513,599 B2 * 8/2013 Franzen ..... H01J 49/062 250/281
8,809,777 B2 * 8/2014 Bajic ..... H01J 49/0445 250/288
8,921,777 B2 12/2014 Bajic
9,082,603 B2 7/2015 Bajic
9,378,938 B2 * 6/2016 Gordon ..... H01J 49/0431
9,437,398 B2 * 9/2016 Tomany ..... H01J 37/3171
2005/0236564 A1 10/2005 Keller et al.
2011/0290639 A1 * 12/2011 Gannero-Castano ..... G01N 23/2258 204/192.34
2014/0339420 A1 11/2014 Bajic
2015/0155151 A1 6/2015 Bajic
2017/0069479 A1 * 3/2017 Bajic ..... H01J 49/142

FOREIGN PATENT DOCUMENTS

JP 4639341 A 2/2011
WO 2007125726 A1 11/2007

OTHER PUBLICATIONS

Jose J. Perez et al., "Transmission-mode direct analysis in real time and desorption electrospray ionization mass spectrometry of insecticide-treated bednets for malaria control", The Analyst, vol. 135, No. 4, pp. 712-719, Jan. 2010.

* cited by examiner

AMBIENT IONISATION WITH AN IMPACTOR SPRAY SOURCE

CROSS-REFERENCE TO RELATED APPLICATIONS

This application is a continuation of U.S. patent application Ser. No. 15/121,916 filed on Aug. 26, 2016, which is the U.S. National Stage Application of International Application No. PCT/GB2015/050566, filed on Feb. 26, 2015 which claims priority to and the benefit of United Kingdom patent application No. 1403335.1 filed on Feb. 26, 2014 and European patent application No. 14156748.7 filed on Feb. 26, 2014. The entire content of each of which are incorporated herein by reference in their entirety.

BACKGROUND TO THE PRESENT INVENTION

The present invention relates to an ion source for a mass spectrometer and a method of ionising a sample. The preferred embodiment relates to a mass spectrometer and a method of mass spectrometry.

A known impactor spray Atmospheric Pressure Ionisation ("API") ion source is disclosed in WO2012/143737 (Micromass). According to the known ion source an analyte is dissolved in solution and is introduced to a nebuliser. The heated high velocity liquid spray which is emitted from the nebuliser is arranged to impact upon a relatively small cylindrical rod target that is held at a high electrical potential with respect to the potential of the nebuliser. The resulting plume from the target is then sampled into a mass spectrometer for subsequent mass analysis. Information relating to the analyte such as the mass to charge ratio of analyte ion can be determined from the analysis.

It is also known to separate the analyte solution in a liquid chromatographic column prior to its introduction into the nebuliser. This allows additional chromatographic information relating to the analyte to be determined.

Other commercially available ambient Atmospheric Pressure Ionisation ("API") ion sources include Desorption Electrospray ("DESI") ion sources (see, for example, WO2005/094389 (Takáts)) and Direct Analysis in Real Time ("DART") ion sources.

It is desired to provide an improved ion source for a mass spectrometer.

SUMMARY OF THE PRESENT INVENTION

According to an aspect of the present invention, there is provided an ion source comprising:

a nebuliser arranged and adapted to emit a liquid spray; and a first target arranged downstream of the nebuliser, wherein the liquid spray is arranged to impact upon the first target;

wherein the ion source further comprises:

a sample target arranged downstream of the first target, wherein a sample to be analysed is provided at the sample target.

The preferred embodiment of the present invention relates to an impactor spray ion source and fast analytical methods for screening samples, preferably with no sample preparation or pre-separation required.

As discussed above, in a conventional impactor spray ion source, the analyte is dissolved in solution and is separated on a liquid chromatographic column prior to introduction into the liquid capillary where subsequent ionization and mass analysis occur.

In contrast, in the preferred embodiment of the present invention, an additional sample target is preloaded with a sample for analysis and is placed downstream of the impactor target. The test analyte may be deposited onto the surface of the sample target with no prior sample preparation or chromatographic separation.

It can therefore be seen that the present invention provides a fast analytical method for identifying, e.g., volatile and involatile, samples with no sample preparation or pre-separation required.

The liquid spray may be arranged to impact upon the first target to ionise the droplets.

The ion source may be arranged and adapted to supply the ionised droplets to a region adjacent to the sample target to ionise the sample.

The ion source may be arranged and adapted to supply the ionised droplets directly to the sample target to ionise the sample.

The sample to be analysed may be deposited on the sample target.

The sample target may be formed at least partially from the sample to be analysed.

According to an embodiment, the ion source may comprise:

one or more devices arranged and adapted to vary the temperature of the sample target with time or to allow the temperature of the sample target to vary with time.

According to an embodiment, the ion source comprises: one or more device arranged and adapted to determine a time at which one or more analytes of the sample are released from the sample target.

According to an embodiment, the liquid spray comprises a solvent.

According to an embodiment, the solvent comprises one or more of: (i) water; (ii) acetonitrile; and (iii) formic acid.

According to an embodiment, the ion source comprises one or more devices arranged and adapted to alter the composition of the solvent over time in a linear, non-linear and/or stepped manner.

According to an embodiment, the one or more devices are arranged and adapted to alter the composition of the solvent over a time scale of around: (i) <10 s; (ii) 10 to 20 s; (iii) 20 to 30 s; (iv) 30 to 40 s; (v) 40 to 50 s; (vi) 50 to 60 s; or (vii) >60 s.

According to an embodiment, the first target is located a distance $y_1$ from the exit of the nebuliser, wherein $y_1$ is selected from the group consisting of: (i) <20 mm; (ii) <19 mm; (iii) <18 mm; (iv) <17 mm; (v) <16 mm; (vi) <15 mm; (vii) <14 mm; (viii) <13 mm; (ix) <12 mm; (x) <11 mm; (xi) <10 mm; (xii) <9 mm; (xiii) <8 mm; (xiv) <7 mm; (xv) <6 mm; (xvi) <5 mm; (xvii) <4 mm; (xviii) <3 mm; and (xix) <2 mm.

According to an embodiment, the ion source comprises one or more devices arranged and adapted to maintain the first target at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx)

60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV; relative to the potential of the nebuliser.

According to an embodiment, the sample target is located at a first distance $x_2$ in a first direction from the first target and at a second distance $y_3$ in a second direction from the first target, wherein the second direction is orthogonal to the first direction and wherein:

(i) $x_2$ is selected from the group consisting of: (i) <−10 mm; (ii) −10 to −9 mm; (iii) −9 to −8 mm; (iv) −8 to −7 mm; (v) −7 to −6 mm; (vi) −6 to −5 mm; (vii) −5 to −4 mm; (viii) −4 to −3 mm; (ix) −3 to −2 mm; (x) −2 to −1 mm (xi); −1 to 0 mm; (xii) 0-1 mm; (xiii) 1-2 mm; (xiv) 2-3 mm; (xv) 3-4 mm; (xvi) 4-5 mm; (xvii) 5-6 mm; (xviii) 6-7 mm; (xix) 7-8 mm; (xx) 8-9 mm; (xxi) 9-10 mm; and (xxii) >10 mm; and/or (ii) $y_3$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to an embodiment, the first target is formed from stainless steel, a metal, gold, a non-metallic substance, a semiconductor, a metal or other substance with a carbide coating, an insulator or a ceramic.

According to an embodiment, the first target comprises a rod, a pin, a needle shaped target, a cone shaped target, a grid or a mesh target.

According to an embodiment, the first target has a diameter of: (i) <1 mm; (ii) 1 to 1.2 mm; (iii) 1.2 to 1.4 mm; (iv) 1.4 to 1.6 mm; (v) 1.6 to 1.8 mm; (vi) 1.8 to 2 mm; or (vii) >2 mm.

According to an embodiment, the ion source comprises one or more devices arranged and adapted to rotate and/or translate the first target.

According to an embodiment, the first target comprises a plurality of target elements arranged and adapted so that droplets of the liquid spray cascade upon the plurality of target elements and/or wherein the first target is arranged to have multiple impact points so that droplets of the liquid spray are ionised by multiple glancing deflections.

According to an embodiment, the sample comprises a liquid, solid or gelatinous sample.

According to an embodiment, the sample target is formed from stainless steel, a metal, gold, a non-metallic substance, a semiconductor, a metal or other substance with a carbide coating, an insulator or a ceramic.

According to an embodiment, the sample target comprises a rod, a pin, a needle shaped target, a cone shaped target, a grid or a mesh.

According to an embodiment, the sample target has a diameter of: (i) <1 mm; (ii) 1 to 1.2 mm; (iii) 1.2 to 1.4 mm; (iv) 1.4 to 1.6 mm; (v) 1.6 to 1.8 mm; (vi) 1.8 to 2 mm; or (vii) >2 mm.

According to an embodiment, the ion source comprises one or more devices arranged and adapted to provide a heated stream of gas to the sample target to vary the temperature of the sample target with time.

According to an embodiment, the one or more devices are arranged and adapted to initially provide the heated stream of gas to the exit of the nebuliser.

According to an embodiment, the one or more devices are arranged and adapted to heat the heated stream of gas to a temperature of (i) <100° C.; (ii) 100 to 200° C.; (iii) 200 to 300° C.; (iv) 300 to 400° C.; (v) 400 to 500° C.; (vi) 500 to 600° C.; (vii) 600 to 700° C.; (viii) 700 to 800° C.; or (ix) >800° C.

According to an embodiment, the ion source comprises one or more devices arranged and adapted to at least partially insulate the sample target from the heated stream of gas.

According to an embodiment, the heated stream of gas comprises nitrogen, air, carbon dioxide and/or ammonia.

According to an embodiment, the ion source comprises one or more heating or cooling devices arranged and adapted to directly vary the temperature of the sample target.

According to an embodiment, the one or more heating devices comprise:

(i) one or more infra-red heaters; and/or (ii) one or more combustion heaters; and/or (iii) one or more laser heaters; and/or (iv) one or more electrical heaters.

According to an embodiment, the one or more cooling devices comprise:

(i) one or more circulatory water or solvent cooling devices; and/or (ii) one or more air cooling devices; and/or (iii) one or more heat pump/refrigerated cooling device; and/or (iv) one or more thermoelectric (Peltier) cooling devices; and/or (v) one or more non-cyclic cooling devices; and/or (vi) one or more liquid gas evaporation cooling devices.

According to an embodiment, the ion source comprises one or more devices arranged and adapted to increase, decrease, progressively increase, progressively decrease, increase in a stepped, linear or non-linear manner, and/or decrease in a stepped, linear or non-linear manner the temperature of the sample target.

According to an embodiment, the ion source comprises one or more devices arranged and adapted to determine a measure of the volatility and/or molecular weight of one or more analytes of the sample based on a time at which the one or more analytes are released from the sample target.

According to another aspect of the present invention, there is provided a mass spectrometer comprising an ion source as described above.

According to an embodiment, the mass spectrometer comprises an ion inlet device downstream of the sample target.

According to an embodiment, the ion inlet device comprises an ion orifice, an ion inlet cone, an ion inlet capillary, an ion inlet heated capillary, an ion tunnel, an ion mobility spectrometer or separator, a differential ion mobility spectrometer, a Field Asymmetric Ion Mobility Spectrometer ("FAIMS") device or other ion inlet.

According to an embodiment, the first target is located at a first distance $x_1$ in a first direction from the ion inlet device and at a second distance $y_2$ in a second direction from the ion inlet device, wherein the second direction is orthogonal to the first direction and wherein:

(i) $x_1$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (ii) $y_2$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

According to an embodiment, the mass spectrometer comprises:

one or more deflection or pusher electrodes; and one or more devices arranged and adapted to apply one or more DC voltages or DC voltage pulses to the one or more deflection or pusher electrodes to deflect or urge ions towards the ion inlet device.

According to an embodiment, the mass spectrometer comprises one or more devices arranged and adapted to maintain the sample target and/or the first target at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV; relative to the potential of the ion inlet device.

According to an embodiment, the mass spectrometer comprises one or more devices arranged and adapted to maintain the ion inlet device at close to ground potential.

According to an embodiment, the mass spectrometer comprises one or more devices arranged and adapted to acquire mass spectral data relating to one or more analytes of the sample, and to use the mass spectral data to determine a time at which the one or more analytes are released from the sample target.

According to an embodiment, the one or more devices are arranged and adapted to generate one or more reconstructed ion chromatograms for one or more selected ions from the mass spectral data, and to use the one or more reconstructed ion chromatograms to determine the time at which the one or more analytes are released from the sample target.

According to an embodiment, the one or more devices are arranged and adapted to determine a measure of the volatility and/or molecular weight of the one or more analytes based on a height, time or width of a peak in at least one of the one or more reconstructed ion chromatograms.

According to an embodiment, the one or more devices are arranged and adapted to determine a measure of the amount of substance of the one or more of analytes by integrating the area under the one or more reconstructed ion chromatograms.

According to another aspect of the present invention there is provided a method of ionising a sample comprising:

emitting a liquid spray from a nebuliser;

causing the liquid spray to impact upon a first target arranged downstream of the nebuliser; and providing a sample to be analysed at a sample target arranged downstream of the first target.

According to another aspect of the present invention there is provided a method of mass spectrometry comprising a method of ionising a sample as described above.

According to another aspect of the present invention there is provided an ion source comprising:

one or more targets;

a sample target downstream of the one or more targets;

a first device arranged and adapted to cause a stream predominantly of droplets to impact upon the one or more targets to ionise the droplets, and to ionise one or more analytes provided at the sample target;

a second device arranged and adapted to vary the temperature of the sample target with time or to allow the temperature of the sample target to vary with time; and a third device arranged and adapted to determine a time at which the one or more analytes are released from the sample target.

According to another aspect of the present invention there is provided a method of ionising a sample comprising:

causing a stream predominantly of droplets to impact upon one or more targets to ionise the droplets;

ionising one or more analytes provided at a sample target downstream of the one or more targets;

varying the temperature of the sample target with time or allowing the temperature of the sample target to vary with time; and determining a time at which the one or more analytes are released from the sample target.

Preferred embodiments of the present invention relate to a method of ionising a sample in which the temperature of an analyte is varied with time, or is allowed to vary with time. As the analyte temperature changes, for example under the influence of a desolvation heater of an impactor spray ionisation ion source and/or an independent heating/cooling device, different components of the analyte are released at different times. The time of release is generally dependent on the molecular weight and/or volatility of the particular analyte component. This "pseudo-chromatographic" time information provides additional information relating to the analyte, which can be used, for example, to identify the components of the analyte.

It can therefore be seen that the preferred embodiment of the present invention provides an improved method for the identification of volatile and involatile samples.

According to an aspect of the present invention there is provided a method of ionising a sample comprising:

ionising one or more analytes provided at a sample target;

varying the temperature of the sample target with time or allowing the temperature of the sample target to vary with time; and determining a time at which the one or more analytes are released from the sample target.

In an embodiment, the method further comprises causing a stream predominantly of droplets to impact upon one or more targets upstream of the sample target to ionise the droplets.

In an embodiment, the method further comprises supplying the ionised droplets to a region adjacent to the sample target to ionise the one or more analytes.

In an embodiment, the method further comprises supplying the ionised droplets directly to the sample target such that the ionised droplets are caused to impact upon the one or more analytes to ionise the one or more analytes.

In an embodiment, the method further comprises nebulising a liquid using a nebuliser to form the stream predominantly of droplets.

In an embodiment, the liquid comprises a solvent.

The solvent may comprise one or more of: (i) water; (ii) acetonitrile; and (iii) formic acid.

In an embodiment, the method further comprises altering the composition of the solvent over time in a linear, non-linear and/or stepped manner.

In an embodiment, the method further comprises altering the composition of the solvent over a time scale of around: (i) <10 s; (ii) 10 to 20 s; (iii) 20 to 30 s; (iv) 30 to 40 s; (v) 40 to 50 s; (vi) 50 to 60 s; or (vii) >60 s.

The one or more targets may be located a distance $y_1$ from the exit of the nebuliser, wherein $y_1$ is selected from the group consisting of: (i) <20 mm; (ii) <19 mm; (iii) <18 mm; (iv) <17 mm; (v) <16 mm; (vi) <15 mm; (vii) <14 mm; (viii) <13 mm; (ix) <12 mm; (x) <11 mm; (xi) <10 mm; (xii) <9 mm; (xiii) <8 mm; (xiv) <7 mm; (xv) <6 mm; (xvi) <5 mm; (xvii) <4 mm; (xviii) <3 mm; and (xix) <2 mm.

In an embodiment, the method further comprises maintaining the sample target and/or one or more targets at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV; relative to the potential of the nebuliser.

The sample target may be located at a first distance $x_2$ in a first direction from the one or more targets and at a second distance $y_3$ in a second direction from the one or more targets, wherein the second direction is orthogonal to the first direction and wherein:

(i) $x_2$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or';

(ii) $y_3$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The one or more targets may be formed from stainless steel, a metal, gold, a non-metallic substance, a semiconductor, a metal or other substance with a carbide coating, an insulator or a ceramic.

The one or more targets may comprise one or more rods, one or more pins, one or more needle shaped targets, one or more cone shaped targets, one or more grids or one or more mesh targets.

The one or more targets may have a diameter of: (i) <1 mm; (ii) 1 to 1.2 mm; (iii) 1.2 to 1.4 mm; (iv) 1.4 to 1.6 mm; (v) 1.6 to 1.8 mm; (vi) 1.8 to 2 mm; or (vii) >2 mm.

In an embodiment, the method further comprises rotating and/or translating the one or more targets.

The one or more targets may comprise a plurality of target elements so that droplets cascade upon a plurality of target elements and/or the target may be arranged to have multiple impact points so that droplets are ionised by multiple glancing deflections.

The one or more analytes may comprise one or more liquid, solid or gelatinous analytes.

The one or more analytes may be deposited on the sample target.

The sample target may be formed from stainless steel, a metal, gold, a non-metallic substance, a semiconductor, a metal or other substance with a carbide coating, an insulator or a ceramic.

The sample target may be at least partially formed from the one or more analytes.

The sample target may comprise a rod, a pin, a needle shaped target, a cone shaped target, a grid or a mesh.

The sample target may have a diameter of: (i) <1 mm; (ii) 1 to 1.2 mm; (iii) 1.2 to 1.4 mm; (iv) 1.4 to 1.6 mm; (v) 1.6 to 1.8 mm; (vi) 1.8 to 2 mm; or (vii) >2 mm.

In an embodiment, the method further comprises providing a heated stream of gas to the sample target to vary the temperature of the sample target with time.

The heated stream of gas may be initially provided to the exit of the nebuliser.

The heated stream of gas may be heated to a temperature of (i) <100° C.; (ii) 100 to 200° C.; (iii) 200 to 300° C.; (iv) 300 to 400° C.; (v) 400 to 500° C.; (vi) 500 to 600° C.; (vii) 600 to 700° C.; (viii) 700 to 800° C.; or (ix) >800° C.

In an embodiment, the method further comprises at least partially insulating the sample target from the heated stream of gas.

The heated stream of gas may comprise nitrogen, air, carbon dioxide and/or ammonia.

In an embodiment, the method further comprises directly varying the temperature of the sample target using one or more heating or cooling devices.

The one or more heating devices may comprise:

(i) one or more infra-red heaters; and/or (ii) one or more combustion heaters; and/or (iii) one or more laser heaters; and/or (iv) one or more electrical heaters.

The one or more cooling devices may comprise:

(i) one or more circulatory water or solvent cooling devices; and/or (ii) one or more air cooling devices; and/or (iii) one or more heat pump or refrigerated cooling device; and/or (iv) one or more thermoelectric (Peltier) cooling devices; and/or (v) one or more non-cyclic cooling devices; and/or (vi) one or more liquid gas evaporation cooling devices.

In an embodiment, the method further comprises increasing, decreasing, progressively increasing, progressively decreasing, increasing in a stepped, linear or non-linear manner, and/or decreasing in a stepped, linear or non-linear manner the temperature of the sample target.

In an embodiment, the method further comprises determining a measure of the volatility and/or molecular weight of the one or more analytes based on the time at which the one or more analytes are released from the sample target.

According to an aspect of the present invention, there is provided a method of mass spectrometry comprising a method of ionising a sample as described above.

In an embodiment, the method further comprises providing an ion inlet device of a mass spectrometer downstream of the sample target.

The ion inlet device may comprise an ion orifice, an ion inlet cone, an ion inlet capillary, an ion inlet heated capillary, an ion tunnel, an ion mobility spectrometer or separator, a differential ion mobility spectrometer, a Field Asymmetric Ion Mobility Spectrometer ("FAIMS") device or other ion inlet.

The one or more targets may be located at a first distance $x_1$ in a first direction from the ion inlet device and at a second distance $y_2$ in a second direction from the ion inlet device, wherein the second direction is orthogonal to the first direction and wherein:

(i) $x_1$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (ii) $y_2$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

In an embodiment, the method further comprises applying one or more DC voltages or DC voltage pulses to one or more deflection or pusher electrodes to deflect or urge ions towards the ion inlet device.

In an embodiment, the method further comprises maintaining the sample target and/or the one or more targets at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) −100 to −90 V; (xv) −90 to −80 V; (xvi) −80 to −70 V; (xvii) −70 to −60 V; (xviii) −60 to −50 V; (xix) −50 to −40 V; (xx) −40 to −30 V; (xxi) −30 to −20 V; (xxii) −20 to −10 V; (xxiii) −10 to 0V; (xxiv) 0-10 V; (xxv) 10-20 V; (xxvi) 20-30 V; (xxvii) 30-40V; (xxviii) 40-50 V; (xxix) 50-60 V; (xxx) 60-70 V; (xxxi) 70-80 V; (xxxii) 80-90 V; (xxxiii) 90-100 V; (xxxiv) 100-200 V; (xxxv) 200-300 V; (xxxvi) 300-400 V; (xxxvii) 400-500 V; (xxxviii) 500-600 V; (xxxix) 600-700 V; (xl) 700-800 V; (xli) 800-900 V; (xlii) 900-1000 V; (xliii) 1-2 kV; (xliv) 2-3 kV; (xlv) 3-4 kV; or (xlvi) 4-5 kV; relative to the potential of the ion inlet device.

In an embodiment, the method further comprises maintaining the ion inlet device at close to ground potential.

In an embodiment, the method further comprises acquiring mass spectral data relating to the one or more analytes, and using the mass spectral data to determine the time at which the one or more analytes are released from the sample target.

In an embodiment, the method further comprises generating one or more reconstructed ion chromatograms for one or more selected ions from the mass spectral data, and using the one or more reconstructed ion chromatograms to determine the time at which the one or more analytes are released from the sample target.

In an embodiment, the method further comprises determining a measure of the volatility and/or molecular weight of the one or more analytes based on a height, time or width of a peak in at least one of the one or more reconstructed ion chromatograms.

In an embodiment, the method further comprises determining a measure of the amount of substance of one or more of the analytes by integrating the area under one or more of the reconstructed ion chromatograms.

According to another aspect of the present invention, there is provided an ion source comprising:

a sample target;

a first device arranged and adapted to ionise one or more analytes provided at the sample target;

a second device arranged and adapted to vary the temperature of the sample target with time or to allow the temperature of the sample target to vary with time; and a third device arranged and adapted to determine a time at which the one or more analytes are released from the sample target.

According to another aspect of the present invention, there is provided a method of ionising a sample comprising:

ionising one or more analytes provided at a sample target;

varying the temperature of the one or more analytes with time or allowing the temperature of the one or more analytes to vary with time; and determining a time at which the one or more analytes are released from the sample target.

According to another aspect of the present invention, there is provided an ion source comprising:

a sample target;

a first device arranged and adapted to ionise one or more analytes provided at the sample target;

a second device arranged and adapted to vary the temperature of the one or more analytes with time or to allow the temperature of the one or more analytes to vary with time; and a third device arranged and adapted to determine a time at which the one or more analytes are released from the sample target.

According to another aspect of the present invention, there is provided a method of ionising a sample comprising: ionising a sample comprising one or more analytes, varying the temperature of the sample and determining a pseudo-elution time of the one or more analytes.

According to another aspect of the present invention, there is provided an ion source comprising:

a first device arranged and adapted to ionise a sample comprising one or more analytes;

a second device arranged and adapted to vary the temperature of the sample; and a third device arranged and adapted to determine a pseudo-elution time of the one or more analytes.

According to another aspect of the present invention, there is provided an impactor ion source comprising a first target and a second sample target arranged downstream of the first target, wherein a sample to be analysed is provided at the sample target.

According to another aspect of the present invention, there is provided a method of ionising a sample comprising:

providing a first target and a second sample target arranged downstream of the first target; and providing a sample to be analysed at the sample target.

According to another aspect of the present invention, there is provided a method of mass spectrometry comprising a method of ionising a sample as described above.

According to another aspect of the present invention, there is provided a mass spectrometer comprising an ion source as described above.

The preferred embodiment of the present invention relates to a fast analytical method for the screening of volatile and involatile samples with no sample preparation or pre-separation required.

As discussed above, in a conventional impactor spray API source, the analyte is dissolved in solution and is separated on a liquid chromatographic column prior to introduction into a nebuliser. The nebuliser generates a heated, high velocity liquid spray which is directed to impact on a small cylindrical rod target that is held at a high potential with respect to the nebuliser. The resulting plume from the target is then sampled into the first vacuum stage of a mass spectrometer for subsequent mass analysis.

In the preferred embodiment of the present invention, an analyte is deposited onto the surface of a sample target, with no prior sample preparation or chromatographic separation required. The additional sample target is placed downstream of the impactor target. As the analyte temperature changes, preferably under the influence of the nebuliser desolvation heater (or an independent heating/cooling device), components of the analyte are released and detected (e.g. by a mass spectrometer) where the time of appearance is generally dependent on the molecular weight and/or volatility of the components of the analyte. In one embodiment, as the temperature of the analyte increases, ions are detected where the time of appearance is generally in the order of increasing molecular weight and volatility of the components of the analyte mixture.

This "pseudo-chromatographic" information affords additional detection selectivity (i.e. additional information relating to the analyte, which can be used to identify the components of the analyte) when compared with conventional methods, and may be advantageously combined with mass or mass to charge ratio data obtained from a mass spectral analysis.

It can therefore be seen that the present invention provides an improved, fast analytical method for identifying volatile and involatile analytes, with no sample preparation or pre-separation required.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) C60 vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENT

A known impactor spray arrangement will first be described with reference to FIG. 1.

Figure 1:
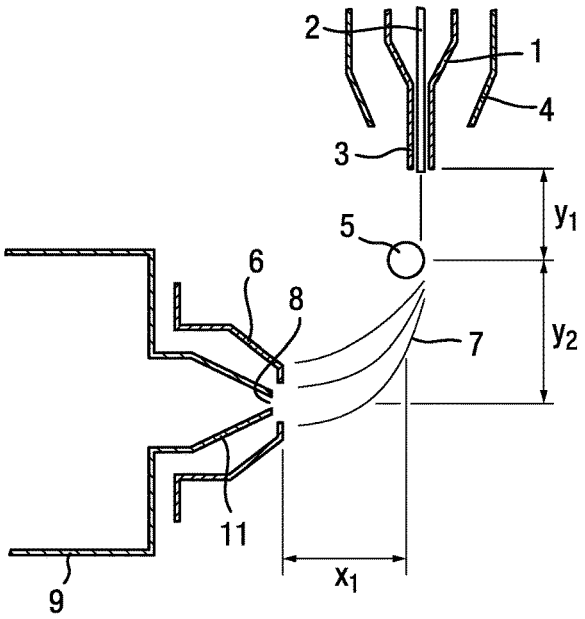
Fig. 1 Prior Art
FIG. 1 schematically shows a conventional impactor spray ion source.

FIG. 1 shows a conventional impactor spray ion source comprising a pneumatic nebuliser assembly 1, a desolvation heater 4, an impactor target 5 and an inlet assembly 6,8,9 to a mass spectrometer. The arrangement may be surrounded by an electrically grounded source enclosure (not shown) that contains an exhaust outlet for the venting of solvent fumes.

The nebuliser assembly 1 comprises an inner liquid capillary 2 and an outer gas capillary 3 which delivers a high velocity stream of gas at the nebuliser tip to aid the atomization of the liquid solvent flow.

The inner liquid capillary 2 typically has an internal diameter of 130 μm and an outside diameter of 270 μm whilst the outer gas capillary 2 typically has an inside diameter of 330 μm.

A gas supply (e.g. nitrogen) is pressurised to approximately 7 bar and liquid flow rates of 0.1 to 1 mL/min are commonly used.

A heated desolvation gas (such as nitrogen) flows between the nebuliser 1 and the heater 4 at a flow rate of typically 1200 L/hr. A high velocity stream of droplets emerges from the nebuliser 1 and impacts upon a stainless steel cylindrical rod target 5 having a diameter of 1.6 mm.

The dimensions $x_1$ (the distance between the ion inlet assembly 6, 8, 9 and the impactor target 5 in a first, x, direction), $y_1$ (the distance between the nebuliser 1 and the impactor target 5 in a second, y, direction) and $y_2$ (the distance between the ion inlet assembly 6, 8, 9 and the impactor target 5 in the y direction) as shown in FIG. 1 are typically 5 mm, 3 mm and 7 mm respectively.

The nebuliser 1 and impactor target 5 are typically held at 0 V and 1 kV, respectively, whilst the mass spectrometer inlet is typically held at a potential close to ground potential (0-100V).

A nitrogen curtain gas flow of typically 150 L/hr passes between the cone gas nozzle 6 and an ion inlet cone 11. Ions, charged particles or neutrals that are contained within the gas flow wake 7 from the impactor target 5 may enter the mass spectrometer via the ion inlet orifice 8. The ion inlet orifice 8 forms a boundary between a first vacuum region 9 of the mass spectrometer and the atmospheric pressure region of the source enclosure.

When the diameter of the impactor target 5 is significantly greater than the internal diameter of the liquid capillary 2 it is advantageous to direct the spray such that it impacts the target 5 on the upper right hand quadrant in a manner substantially as shown in FIG. 1. Under these conditions, the gas flow wake 7 follows the curvature of the target (due to the coanda effect) and is swung in the direction of the ion inlet orifice 8 which results in a greater ion signal intensity.

Figure 2:
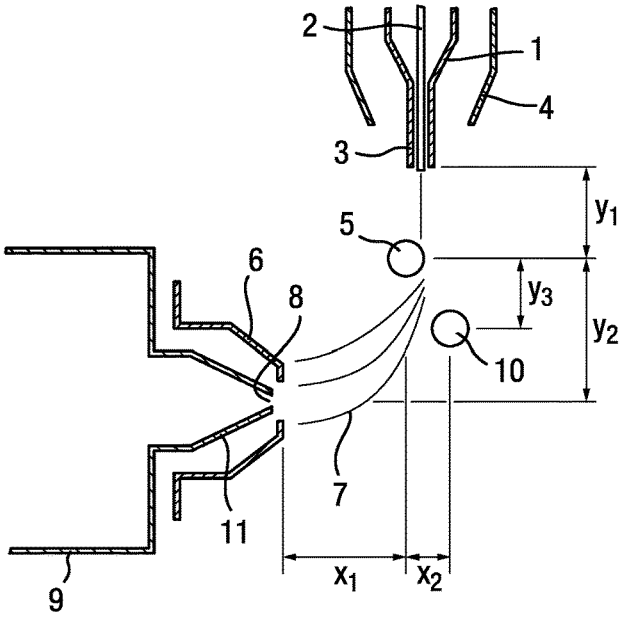
FIG. 2 schematically shows an ion source in accordance with an embodiment of the present invention.

FIG. 2 shows a schematic diagram of a modified impactor spray ion source in accordance with an embodiment of the present invention for ambient ionisation. This embodiment corresponds to the arrangement depicted in FIG. 1, with the addition of a secondary target 10 that is preferably provided. The secondary target 10 preferably comprises stainless steel and preferably comprises a cylindrical target. The secondary target 10 may also be referred to as a sample target 10.

The secondary target 10 is preferably placed downstream of the impactor target 5 and is preferably located in close proximity to the gas flow wake 7. The dimensions $x_2$ (the distance between the impactor target 5 and the sample target 10 in the x direction), and $y_3$ (the distance between the impactor target 5 and the sample target 10 in the y direction) as shown in FIG. 2 are preferably 2 mm and 4 mm respectively.

According to a particularly preferred embodiment a test analyte is preferably deposited onto or otherwise located on the surface of the sample target 10. The sample target 10 is then preferably introduced into the source so as to be located substantially as shown in FIG. 2. The sample target 10 is preferably introduced via a door (not shown) that is preferably positioned on the front face of the source enclosure (not shown).

It should be noted that in a conventional impactor spray source as shown in FIG. 1 the analyte is dissolved in solution and is typically separated on a liquid chromatographic column prior to introduction into a liquid capillary 2 where subsequent ionization and mass analysis occur. A particular advantageous aspect of the preferred embodiment is that no prior sample preparation or chromatographic separation is required in contrast to conventional impactor spray sources.

According to the preferred embodiment, the temperature of the sample target 10 is varied with time (or is allowed to vary with time), preferably under the influence of the desolvation heater 4. The times at which components of the analyte are released from the sample target 10 are then determined, preferably by mass analysing analyte ions as they are released from the sample target 10. This information may advantageously be used to determine a measure of the volatility and/or molecular weight of the components of the analyte, and/or to distinguish between relatively volatile and relatively involatile components of the analyte.

To illustrate the utility of the preferred embodiment a chocolate sample was prepared by forcing the sample target through the solid chocolate bar at room temperature and then slowly withdrawing the target leaving a thin, semi-transparent film of sample on the target surface. The impactor spray source was set to a desolvation heater temperature of 550° C. and a solvent consisting of 50/50 acetonitrile/water (containing 0.1% formic acid) was introduced into the liquid capillary 2 at a flow rate of 0.6 mL/min prior to sample insertion.

A mass spectrum data acquisition file was started on a triple quadrupole mass spectrometer in MS full scan positive ion mode (m/z 50-1000 in 0.5 seconds). The sample target 10 (initially at room temperature) was introduced into the impactor source via the source door whilst the mass spectrometer was acquiring data. The impactor target 5 was held at +1 kV whilst the sample target 10 was electrically floating. The resulting mass spectra obtained from the chocolate sample were acquired until the total ion current ("TIC") returned to the level obtained prior to sample introduction.

Figure 3:
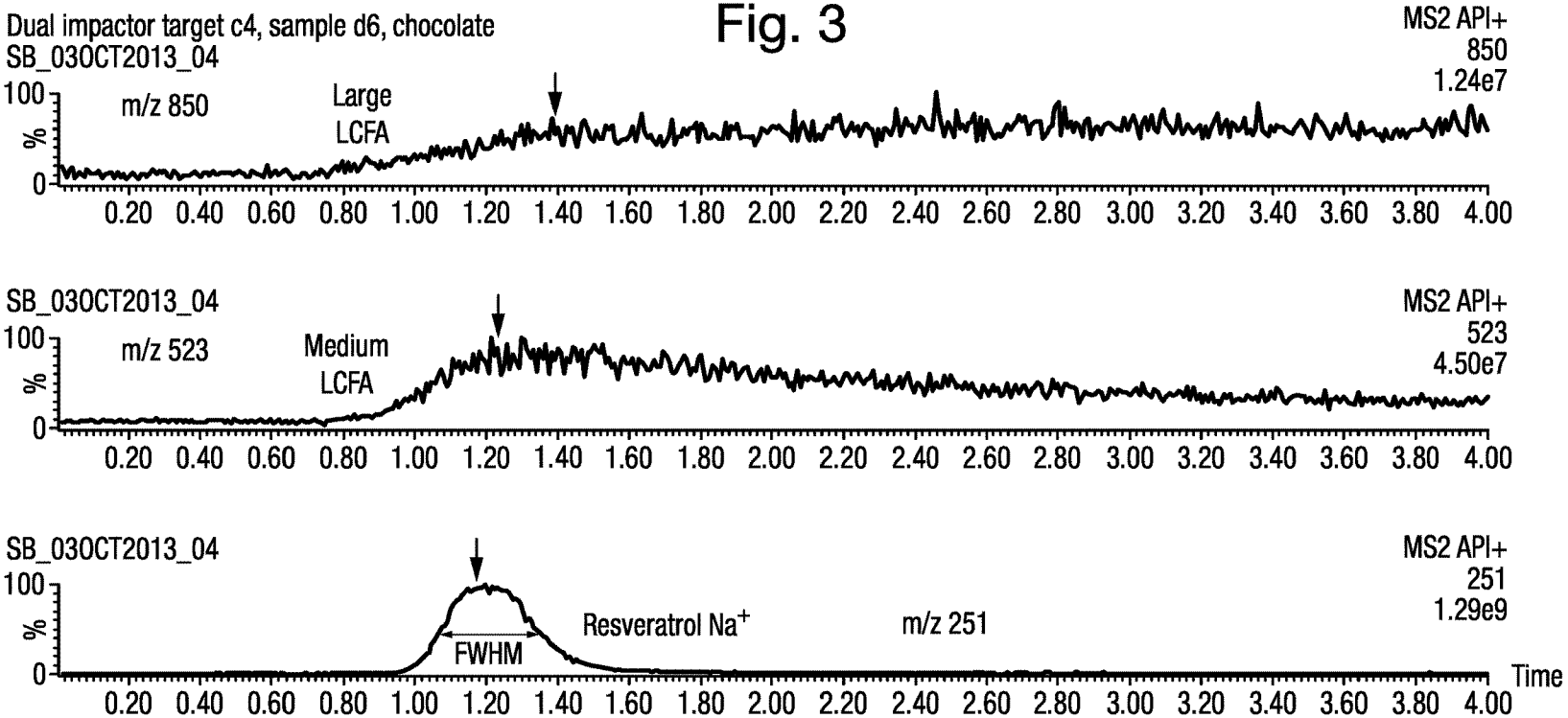
FIG. 3 shows reconstructed ion chromatograms generated in accordance with embodiments of the present invention.
Figure 3:
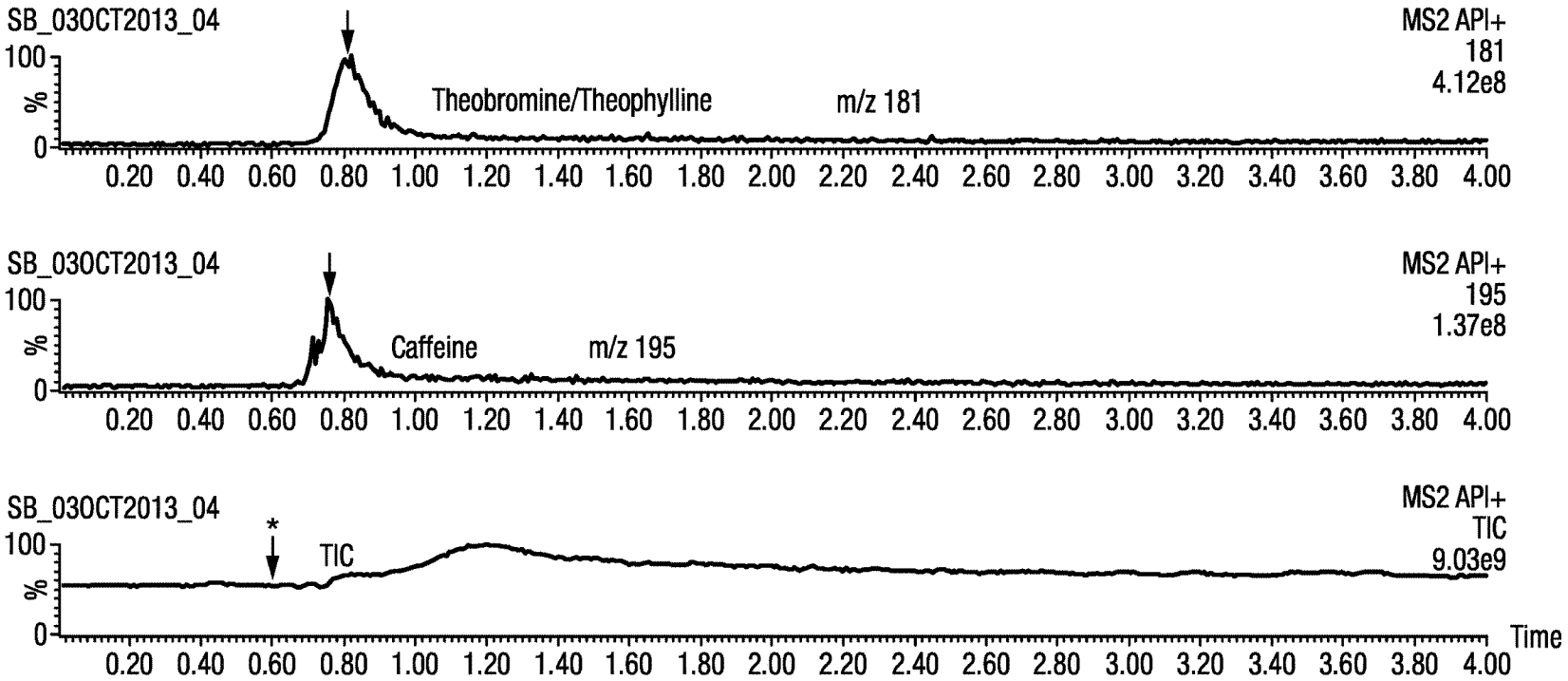

The lower trace of FIG. 3 shows the total ion current ("TIC") obtained with a chocolate sample, where the asterisk denotes the time at which the sample was introduced. The TIC can be seen to increase from a base level after introduction of the sample, to reach a maximum, and to decrease thereafter.

Figure 4:
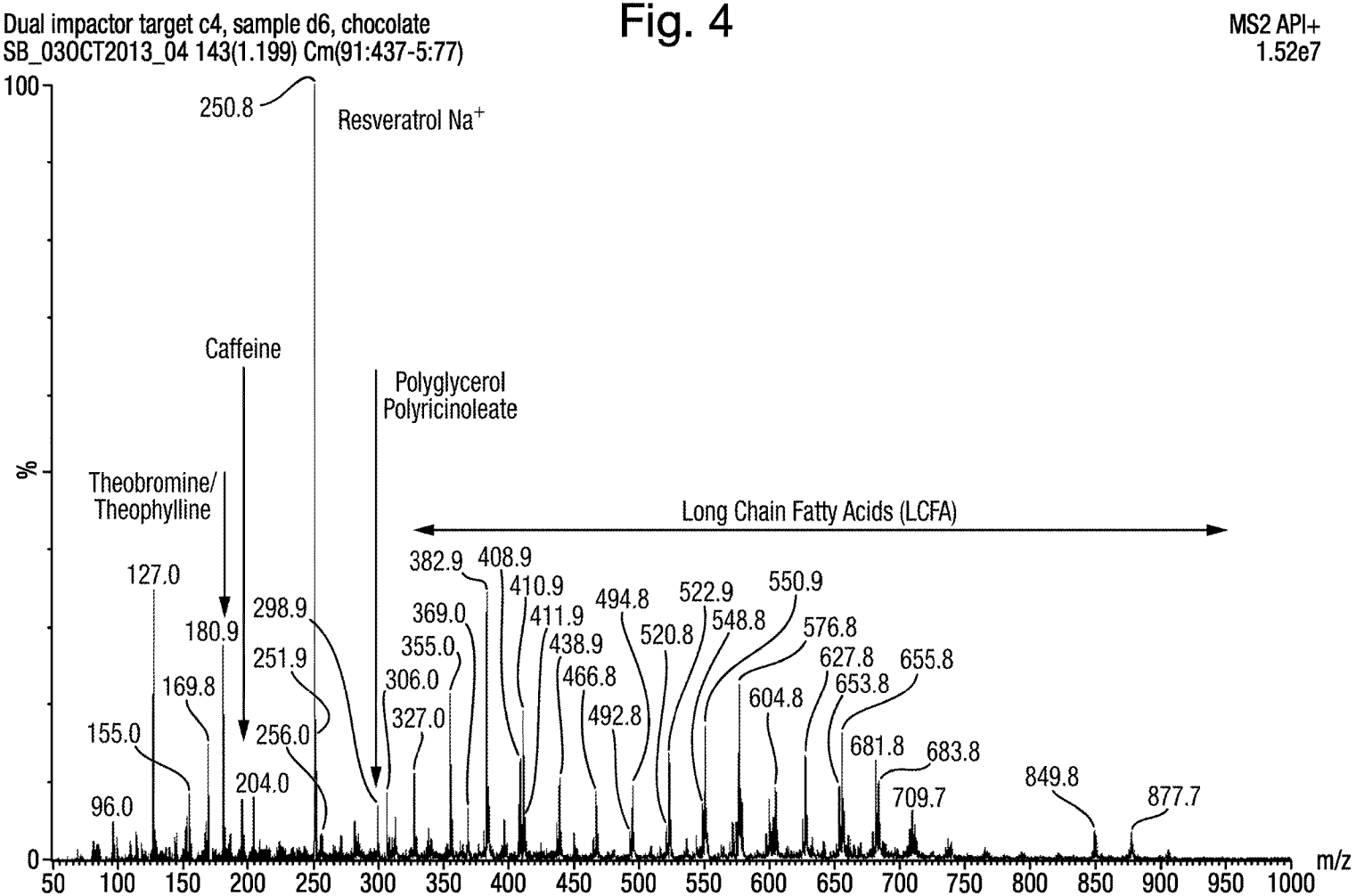
FIG. 4 shows mass spectral data acquired according to embodiments of the present invention.

FIG. 4 is a combined mass spectrum obtained from 0.75 to 3.5 minutes with background subtraction from 0 to 0.6 minutes, and reveals a number of mass spectral peaks which are commonly associated with chocolate. Thus, the increase in the TIC observed in the bottom panel of FIG. 3 is clearly due to ionisation of the chocolate sample.

FIG. 3 also shows the signal profiles obtained from reconstructed ion chromatograms (RIC) of a number of selected ions. The arrows indicate the time at which each ion signal reaches its maximum level. After introduction of the sample, the sample target temperature will rise rapidly from room temperature to the temperature of the gas plume from the impactor ion source. As the temperature increases, signal from relatively volatile analytes is seen before that of relatively involatile analytes.

For example, FIG. 3 shows that smaller, more volatile analytes such as caffeine and theobromine/theophylline immediately give rise to a signal having a small full-width at half maximum height (FWHM), whilst relatively involatile analytes, such as fatty acids, appear at a later time and persist for longer (i.e. have a larger FWHM).

Thus, it can be seen from the data in FIG. 3 that sample volatility may be advantageously used in embodiments of the present invention as an analytical factor, giving rise to a "pseudo-chromatographic" separation of analyte components (the term "pseudo" is used herein since the appearance time of a particular component also depends on factors such as sample film thickness and matrix etc.).

Furthermore, a measure of the amount of substance of each analyte in the sample can preferably be determined by integrating the area under the appropriate reconstructed ion chromatogram. This adds a degree of analyte quantification to the preferred embodiment.

As a refinement to the above technique, in an embodiment a heating and/or cooling device is provided which directly controls the temperature of the sample target 10, preferably independently of the desolvation heater 4. This can be used to enhance the specificity and sensitivity of the analysis.

For example, by heating or cooling the sample target 10, it is possible to accelerate or decelerate the evolution of the signal (i.e. to control the time at which the components of the analyte will be released from the sample target 10). In one embodiment, by heating the sample target 10 (at an appropriate time), the evolution of the signal arising from the lower volatility components may be accelerated. This will result in a decrease of the chromatographic peak widths (FWHM) and a corresponding increase in peak height, and hence an increase in sensitivity for the lower volatility components.

For example, by applying heating to the sample target 10 at 0.9 minutes, the evolution of the signal from the lower volatility components (e.g. those having mass to charge ratios of 251, 523 and 850 in FIG. 3) is accelerated. This results in a decrease of the chromatographic peak widths (FWHM) and a corresponding increase in peak height, and hence, sensitivity for these components.

According to an embodiment, the temperature of the sample target 10 may be increased or decreased in a stepped, linear or non-linear manner. The increase and/or decrease in temperature may be applied at any appropriate time. For example, in FIG. 3, an additional temperature increase may be applied as a step or steps in the power profile or as a linear power gradient from t=0.9 minutes (as above).

In one embodiment, by cooling the sample target 10 (at an appropriate time), the evolution of the signal arising from the higher volatility components may be decelerated. For example, by applying cooling from t=0.6 to 1.0 minutes, the separation of the relatively volatile components (i.e. those having mass to charge ratios of 182 and 195) is increased.

In the data of FIG. 3, theobromine and theophylline (which are both known to be common in cocoa-related products and which both have a nominal mass to charge ratio of 181) could not be distinguished by the quadrupole mass spectrometer owing to its limited mass resolution. However, in various embodiments, the techniques of the present invention may be improved by combining them with ion mobility spectrometry ("IMS"), high resolution mass spectrometry and/or tandem mass spectrometry techniques.

Embodiments of the present invention may be used to obtain data from a wide variety of samples. For example, the techniques described herein have been used to obtain data for fruit and fingerprint material.

In the demonstration of a preferred embodiment described above, the sample target 10 was positioned in close proximity with, but outside of the high velocity gas flow 7 containing solvent droplets. It is improbable that a large proportion of the total droplet stream will strike the sample target 10 under these conditions.

However, according to less preferred embodiments the sample target 10 may be located in any position downstream of the impactor target 5. According to an embodiment the sample target 10 may be located in a position such that the gas flow 7 and the associated droplet stream impinges upon the sample target 10.

According to this embodiment an ambient ionization source is preferably provided that is analogous to a DESI ion source. Analyte from the target 10 is preferably desorbed into the impinging droplets, and the droplets subsequently yield ions downstream of the impact point. In this embodiment, the composition of the solvent has preferential extraction attributes, for example polar analytes will be favourably desorbed by solvents having high water concentrations, etc.

According to an embodiment the solvent composition may be varied over time so that a large range of analyte components will be desorbed in the same experimental run or acquisition. Preferably, ballistic (fast) solvent composition gradients or steps are applied over time scales of less than one minute to desorb as many analytes as is possible.

According to embodiments the source may be operated with the impactor target 5 or the sample target 10 held at ground potential, the same potential, a raised potential with respect to the inlet or any combination of these.

In an embodiment, in order to reduce the "cross-talk" between the desolvation heater temperature and the (independent) sample target temperature, a baffle may be provided that surrounds the sample target. Preferably, the baffle is arranged and adapted to insulate the sample target 10 from a heated stream of gas from the nebuliser. Preferably the baffle can be (mechanically) withdrawn or reinstated. This also negates the need to open the source door for sample introduction, and is more efficient in embodiments where sample cooling is used.

According to another embodiment alternative nebuliser gases may be used, such as air, carbon dioxide or nitrogen that contains ammonia.

Although the present invention has been described with reference to preferred embodiments, it will be understood by those skilled in the art that various changes in form and detail may be made without departing from the scope of the invention as set forth in the accompanying claims.

What is claimed is:

1. An ion source comprising:

a nebuliser arranged and adapted to emit a liquid spray;

a first target arranged downstream of said nebuliser, wherein said liquid spray is arranged to impact upon said first target;

wherein said ion source further comprises:

a sample target located at a distance of (i) 1-2 mm; (ii) 2-3 mm; (iii) 3-4 mm; (iv) 4-5 mm; (v) 5-6 mm; (vi) 6-7 mm; (vii) 7-8 mm; (viii) 8-9 mm; (ix) 9-10 mm; or (x) >10 mm from said first target, wherein a sample to be analysed is provided at said sample target.

2. An ion source as claimed in claim 1, wherein said liquid spray is arranged to impact upon said first target to ionise droplets of said liquid spray.

3. An ion source as claimed in claim 1, wherein said sample to be analysed is deposited on said sample target.

4. An ion source as claimed in claim 1, wherein said sample target is formed at least partially from said sample to be analysed.

5. An ion source as claimed in claim 1, wherein said liquid spray comprises a solvent.

6. An ion source as claimed in claim 5, wherein said solvent comprises one or more of: (i) water; (ii) acetonitrile; and (iii) formic acid.

7. An ion source as claimed in claim 1, wherein said first target is located a distance $y_1$ from the exit of said nebuliser, wherein $y_1$ is selected from the group consisting of: (i) <20 mm; (ii) <19 mm; (iii) <18 mm; (iv) <17 mm; (v) <16 mm; (vi) <15 mm; (vii) <14 mm; (viii) <13 mm; (ix) <12 mm; (x) <11 mm; (xi) <10 mm; (xii) <9 mm; (xiii) <8 mm; (xiv) <7 mm; (xv) <6 mm; (xvi) <5 mm; (xvii) <4 mm; (xviii) <3 mm; and (xix) <2 mm.

8. An ion source as claimed in claim 1, wherein said ion source comprises:

one or more devices arranged and adapted to maintain said first target at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) 100-200 V; (xv) 200-300 V; (xvi) 300-400 V; (xvii) 400-500 V; (xviii) 500-600 V; (xix) 600-700 V; (xx) 700-800 V; (xxi) 800-900 V; (xxii) 900-1000 V; (xxiii) 1-2 kV; (xxiv) 2-3 kV; (xxv) 3-4 kV; or (xxvi) 4-5 kV; relative to the potential of said nebuliser.

9. An ion source as claimed in claim 1, wherein said sample target is located at a first distance $x_2$ in a first direction from said first target and wherein:

$x_2$ is selected from the group consisting of: (i) −10 to −9 mm; (ii) −9 to −8 mm; (iii) −8 to −7 mm; (iv) −7 to −6 mm; (v) −6 to −5 mm; (vi) −5 to −4 mm; (vii) −4 to −3 mm; (viii) −3 to −2 mm; (ix) −2 to −1 mm (x); −1 to 0 mm; (xi) 0-1 mm; (xii) 1-2 mm; (xiii) 2-3 mm; (xiv) 3-4 mm; (xv) 4-5 mm; (xvi) 5-6 mm; (xvii) 6-7 mm; (xviii) 7-8 mm; (xix) 8-9 mm; and (xx) 9-10 mm.

10. An ion source as claimed in claim 1, wherein said sample target is located at a second distance $y_3$ in a second direction from said first target, wherein said second direction is orthogonal to said first direction and wherein:

$y_3$ is selected from the group consisting of: (i) 1-2 mm; (ii) 2-3 mm; (iii) 3-4 mm; (iv) 4-5 mm; (v) 5-6 mm; (vi) 6-7 mm; (vii) 7-8 mm; (viii) 8-9 mm; (ix) 9-10 mm; and (x) >10 mm.

11. An ion source as claimed in claim 1, wherein said ion source comprises:

one or more devices arranged and adapted to provide a heated stream of gas to said sample target.

12. An ion source as claimed in claim 11, wherein said one or more devices are arranged and adapted to provide said heated stream of gas to the exit of said nebuliser.

13. An ion source as claimed in claim 11, wherein said one or more devices are arranged and adapted to heat said heated stream of gas to a temperature of (i) 100 to 200° C.; (ii) 200 to 300° C.; (iii) 300 to 400° C.; (iv) 400 to 500° C.; (v) 500 to 600° C.; (vi) 600 to 700° C.; (vii) 700 to 800° C.; or (viii) >800° C.

14. A mass spectrometer comprising an ion source as claimed in claim 1.

15. A mass spectrometer as claimed in claim 14, wherein said mass spectrometer comprises an ion inlet device.

16. A mass spectrometer as claimed in claim 15, wherein said first target is located at a first distance $x_1$ in a first direction from said ion inlet device and at a second distance $y_2$ in a second direction from said ion inlet device, wherein said second direction is orthogonal to said first direction and wherein:

(i) $x_1$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm; and/or (ii) $y_2$ is selected from the group consisting of: (i) 0-1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

17. A mass spectrometer as claimed in claim 15, wherein said mass spectrometer comprises:

one or more devices arranged and adapted to maintain said first target at a potential of: (i) −5 to −4 kV; (ii) −4 to −3 kV; (iii) −3 to −2 kV; (iv) −2 to −1 kV; (v) −1000 to −900 V; (vi) −900 to −800 V; (vii) −800 to −700 V; (viii) −700 to −600 V; (ix) −600 to −500 V; (x) −500 to −400 V; (xi) −400 to −300 V; (xii) −300 to −200 V; (xiii) −200 to −100 V; (xiv) 100-200 V; (xv) 200-300 V; (xvi) 300-400 V; (xvii) 400-500 V; (xviii) 500-600 V; (xix) 600-700 V; (xx) 700-800 V; (xxi) 800-900 V; (xxii) 900-1000 V; (xxiii) 1-2 kV; (xxiv) 2-3 kV; (xxv) 3-4 kV; or (xxvi) 4-5 kV; relative to the potential of said ion inlet device.

18. A mass spectrometer as claimed in claim 15, wherein said sample target is maintained at a potential of: (i) −100 to −90 V; (ii) −90 to −80 V; (iii) −80 to −70 V; (iv) −70 to −60 V; (v) −60 to −50 V; (vi) −50 to −40 V; (vii) −40 to −30 V; (viii) −30 to −20 V; (ix) −20 to −10 V; (x) −10 to 0V; (xi) 0-10 V; (xii) 10-20 V; (xiii) 20-30 V; (xiv) 30-40V; (xv) 40-50 V; (xvi) 50-60 V; (xvii) 60-70 V; (xviii) 70-80 V; (xix) 80-90 V; (xx) 90-100 V; relative to the potential of said ion inlet device.

19. A mass spectrometer as claimed in claim 14, wherein said mass spectrometer comprises:

one or more devices arranged and adapted to acquire mass spectral data relating to one or more analytes of said sample.

20. A method of ionising a sample comprising:

emitting a liquid spray from a nebuliser;

causing said liquid spray to impact upon a first target arranged downstream of said nebuliser; and providing a sample to be analysed at a sample target located at a distance of (i) 1-2 mm; (ii) 2-3 mm; (iii) 3-4 mm; (iv) 4-5 mm; (v) 5-6 mm; (vi) 6-7 mm; (vii) 7-8 mm; (viii) 8-9 mm; (ix) 9-10 mm; or (x) >10 mm from said first target.

* * * * *